United States Patent [19]

John

[11] Patent Number: 4,840,216

[45] Date of Patent: Jun. 20, 1989

[54] VALANCE BRACKET FOR A VERTICAL BLIND

[75] Inventor: Julius F. John, Redondo Beach, Calif.

[73] Assignee: Home Fashions, Inc., Santa Monica, Calif.

[21] Appl. No.: 196,134

[22] Filed: May 19, 1988

[51] Int. Cl.[4] ..... E06B 9/38

[52] U.S. Cl. ..... 160/178.1; 160/38; 160/902; 16/95 D; 16/87.4 R

[58] Field of Search ..... 160/38, 39, 178.1, 902; 248/262; 5/493; 16/87.4 R, 95 D

[56] References Cited

U.S. PATENT DOCUMENTS

| | | | |
|---|---|---|---|
| 657,538 | 9/1900 | Hellstrom . | |
| 1,009,359 | 11/1911 | Walter . | |
| 1,492,200 | 6/1921 | Burns . | |
| 1,568,872 | 12/1924 | Briggs . | |
| 1,781,262 | 8/1928 | Wintrob . | |
| 1,837,632 | 9/1931 | Skowronski . | |
| 2,163,511 | 5/1938 | Cardillo . | |
| 2,329,546 | 3/1943 | Lee . | |
| 2,597,578 | 2/1951 | Ganter . | |
| 2,604,155 | 7/1952 | Junkunc . | |
| 2,986,627 | 5/1957 | Marriett . | |
| 3,297,075 | 1/1967 | Howell et al. . | |
| 3,469,619 | 8/1968 | Barnett . | |
| 3,614,045 | 1/1969 | Cegielski, Jr. . | |
| 3,818,543 | 6/1974 | Baker, Sr. | 16/87.4 R |
| 3,965,540 | 6/1976 | Moore . | |
| 3,983,600 | 10/1976 | Smith . | |
| 4,079,770 | 3/1978 | Woodle . | |
| 4,114,233 | 9/1978 | Hamilton . | |
| 4,228,980 | 10/1980 | Beauchamp et al. . | |
| 4,254,813 | 3/1981 | Vecchiarelli . | |
| 4,254,814 | 3/1981 | Vecchiarelli . | |
| 4,335,865 | 6/1982 | Cormier . | |
| 4,384,605 | 5/1983 | Schaeffer et al. . | |
| 4,662,421 | 5/1987 | Basmadji et al. . | |
| 4,693,380 | 9/1987 | Muth | 248/225.1 X |

*Primary Examiner*—Blair M. Johnson
*Attorney, Agent, or Firm*—Welsh & Katz, Ltd.

[57] ABSTRACT

A valance assembly is disclosed which allows the hook-in assembly of a valance support onto the head rail, and the snap-in mounting of the valance on the valance support. The valance support in one embodiment has the cross-section of an I-beam for strength with a minimum of material and in another embodiment provides for two parallel offset valances to provide a vehicle for contrasting colors over the blinds and head rail.

23 Claims, 2 Drawing Sheets

113
159
155
134
129
135
127
131
145
137
147
143
115
110
153
157
114
141
142
133
112
139
140
119
111
117

VALANCE BRACKET FOR A VERTICAL BLIND

BACKGROUND OF THE INVENTION

The present invention relates to decorative fixtures for use with window coverings and more particularly, to valance supports for vertical and horizontal venetian blinds.

In general, venetian blinds have a head rail or channel support which supports the blinds and conceals mechanisms which may affect the raising, lowering, or tilting of the louvers or slats. These slats may be horizontal and suspended by tape ladders in a vertically-spaced relationship below the head rail. In the alternative, the blind may have vertical slats individually suspended from the head rail in a horizontally-spaced relationship. Head rails are not generally considered attractive, and therefore a valance with a more pleasing appearance than the rail head itself is commonly used to cover the head rail in a supporting arrangement.

SUMMARY OF THE INVENTION

Accordingly, an object of the subject invention is an approved apparatus for mounting valances on the head rail of a venetian blind.

A further object of the subject invention is a valance assembly which provides for a direct and facile assembly of the valance, the valance bracket, and the head rail without the need for additional hardware.

A further object of the subject invention is a valance assembly which has a rigid support, yet a thin cross-section to allow savings of material costs.

A still further object of the subject invention is a means for supporting a double valance having parallel, spaced, and overlapping valances in a manner which permits easy assembly.

These and other objects are attained by the subject invention, wherein there is provided a valance assembly comprising a valance support and a valance bracket. The valance bracket is mounted on the head rail and in turn supports the valance. The head rail, or overhead support, carries the blinds which may be either vertical or horizontally-oriented blinds. The head rail is generally secured in position by means of an angle bracket or the like which is attached to a wall or ceiling. The valance bracket in one embodiment comprises an I-beam type structure which is then mounted on the head rail. One or more such valance brackets may be used, dependent on the length of the head rail. The valance bracket has an elongated recess with a depression located within the recess. The valance comprises an L-shaped structure. The upper horizontal arm of the L-shaped structure has a downwardly facing detent which engages the depression within the recess of the valance bracket when the horizontal arm of the valance is inserted into the valance bracket. The valance bracket has a cross-section in the shape of an I-beam with the center web in vertical orientation. A second valance may also be supported by the same bracket, with the lower valance and valance bracket spaced and offset from the upper valance and valance bracket.

Other objects and features of the invention will become more apparent upon a consideration of the accompanying drawings, wherein:

DETAILED DESCRIPTION OF THE EMBODIMENT

Figure 1:
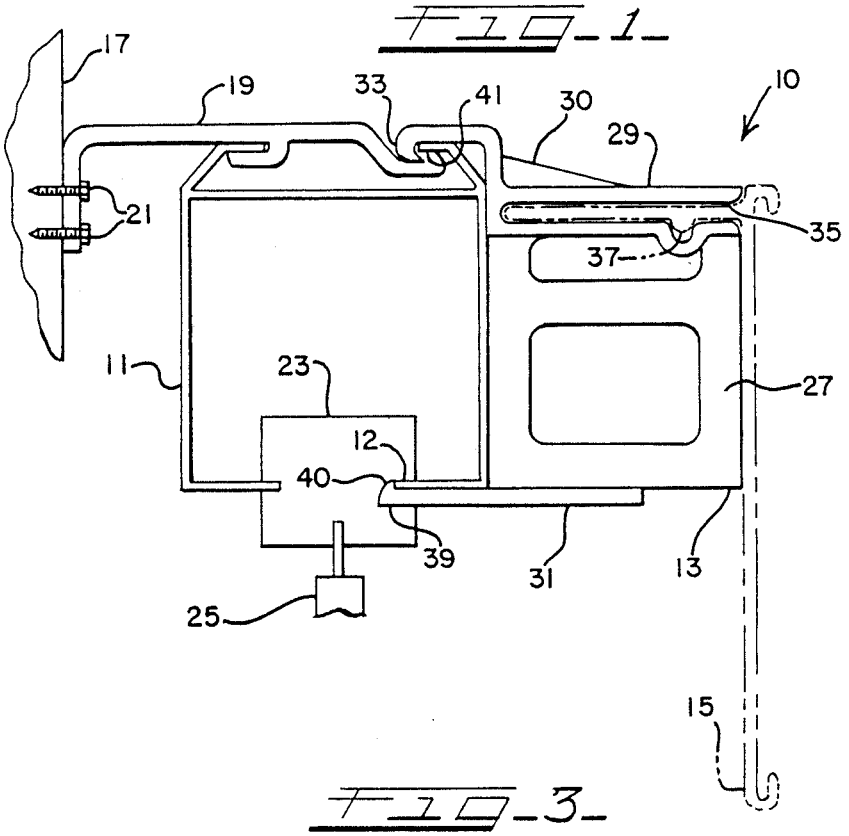
FIG. 1 is a cross-sectional view of a one embodiment of the valance assembly of the subject invention.

Referring now to FIG. 1, there is shown a valance assembly 10 mounted on a head rail 11. Valance assembly 10 comprises valance bracket 13 and valance 15, which is supported on valance bracket 13 valance 15 is shown is phantom. The head rail 11 is supported on a side wall 17 by a suitable angle bracket 19 secured to the wall 17 by screws 21, or the like. In general, angle brackets 19 support the head rail at each end, but a longer span of blinds may be supported by bracket(s) 19 intermediate the ends as well. The head rail 11 supports the blind mechanism 23 shown here as used with vertical blinds. The blind mechanism 23 controls the movement and rotation of blinds 25 in a manner known in the art.

Figure 2:
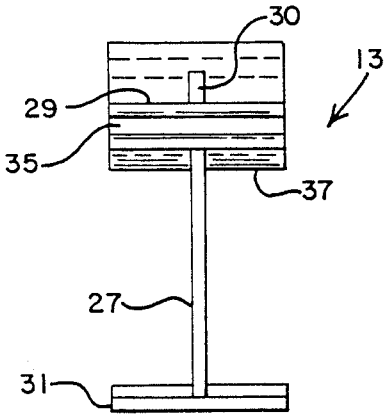
FIG. 2 is a front plan view of a valance bracket of the subject invention.

Valance bracket 13, as shown in FIG. 2, comprises an I-beam type structure having a central web 27, an upper arm 29 and a lower portion 31. Bracket 13 may be formed of nylon, Delrin (polyoxymethylene), high density polyethylene, polyvinyl chloride, polyethylene or the like. The upper portion 29 has a downwardly extending hook-like structure 33 on one end and a horizontal longitudinal recess 35 on another (FIG. 1). A truss or prop 30 may be used to strengthen the arm against excessive bending. Recess 35 extends approximately one inch inwardly towards the head rail. In a central portion on the walls of recess 35 is detent or depression 37.

The lower portion 31 of valance bracket 13 has an arm 39 extending inwardly from the central web 27 on the same side as hook 33. The combination of inwardly extending arms 39 and 33 permit the valance bracket to be secured to a previously mounted head rail by insertion of the top hook portion 33 and upper arm 29 up and over channel arm 41 of the head rail, thereby latching on to channel arm 41 at the outrend of bracket 19. The valance bracket 13 is then brought down until contact of an outer clip portion 40 of lower arm 39 is made over the lower horizontal lip 12 of the head rail 11 to provide secure mounting of the valance bracket on head rail 11. Valance bracket 13 may also be slid into position from a side edge of head rail 11, should sufficient side room be present.

Figure 3:
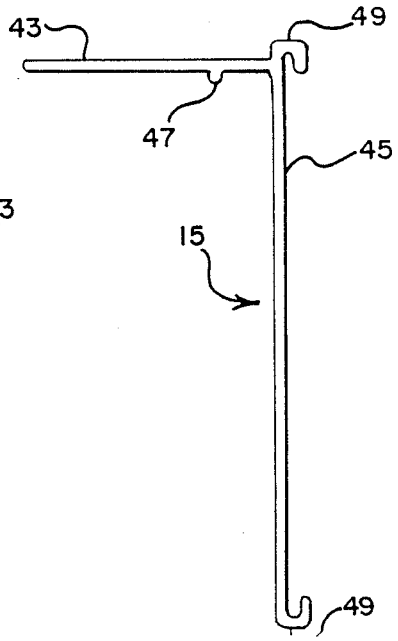
FIG. 3 is a side plan view of a valance of the subject invention.

Valance 15, shown in phantom in FIG. 1 and in solid lines in FIG. 3, comprises an L-shaped structure having an upper horizontal portion 43 and a lower vertical portion 45. Upper portion 43 has a projection 47 on its lower mid-section. Projection 47 is positioned on the upper arm 43 so that when the upper arm 43 of the valance 15 is inserted into the recess 35 of the valance bracket and pushed in substantially completely, projection 47 springs into depression 37 and holds the valance in place. When projection 47 and depression 37 are correctly positioned, the insertion of valance upper arm 43 into the valance bracket recess or channel 35 results in securing the valance to the valance bracket at the desired distance from the head, rail. The vertical face portion 45 of valance 15 may itself be decorative or it may have upper and lower channels 49 formed therein. Decorative inserts (not shown) may be placed within channels 49 and secured therein. The decorative insert may match the louvers in the blind or contrasting colors may be used, as desired.

Figures 4, 5:
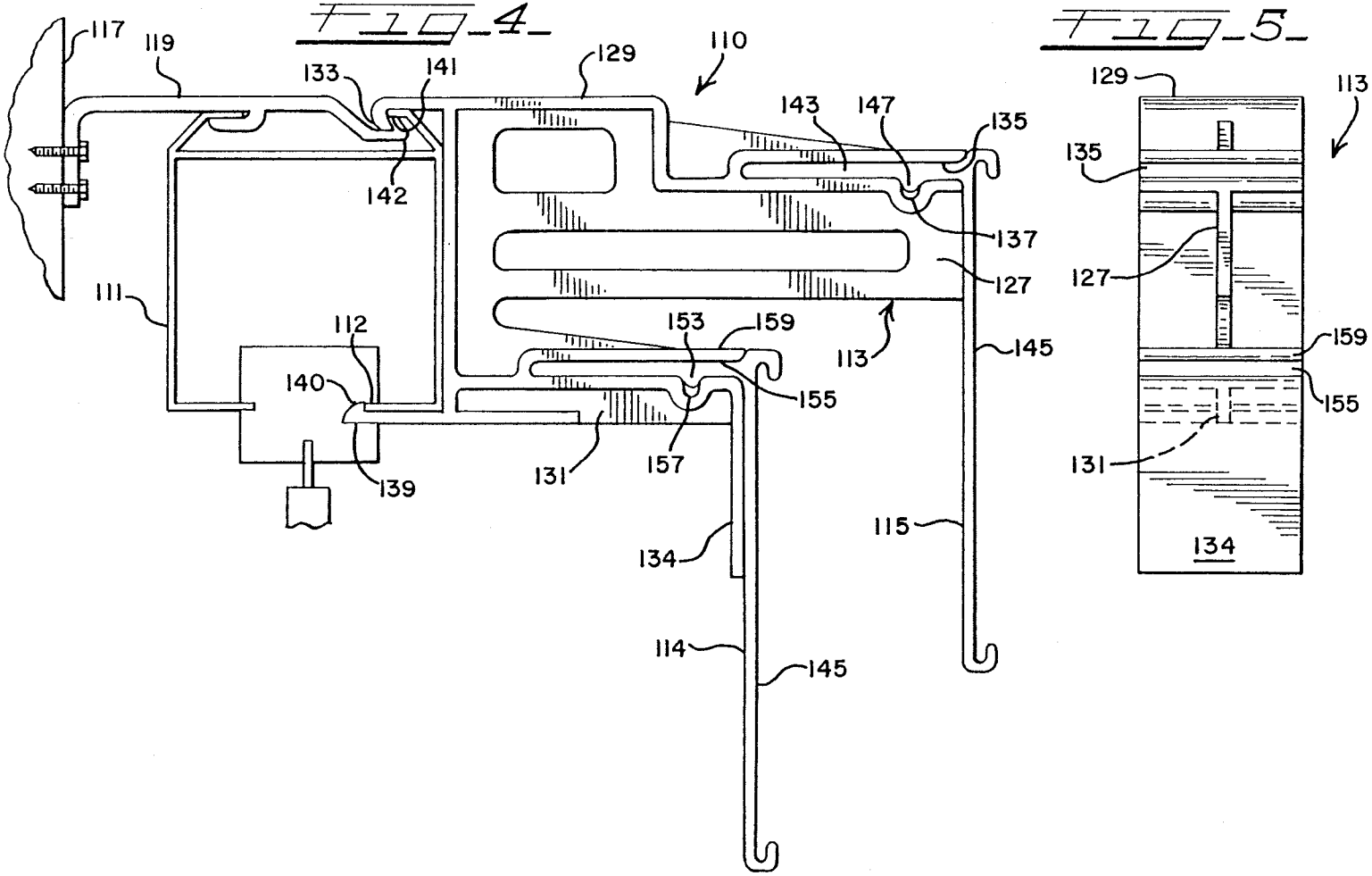
FIG. 4 is a cross-sectional view of another embodiment of the subject invention showing a double valance assembly.
FIG. 5 is a front plan view of the valance bracket of FIG. 4.

An alternative embodiment of the valance bracket is shown in FIG. 4, wherein valance assembly 110 is shown mounted on a head rail 111. Valance assembly 110 comprises valance brackets 113 with valances 114 and 115, which are supported on valance bracket 113. The head rail 111 is supported on a side wall 117 as in the embodiment of FIG. 1 by angle bracket 119.

Upper valance bracket portion 113, as shown in FIG. 5, has a partial upper central web 127, an upper arm 129 and a lower portion 131. As in FIG. 1, the upper portion 129 has a downwardly extending hook-like structure 133 on one end and a longitudinal horizontal recess 135 on another (FIG. 4). Recess 135 extends approximately one inch inwardly towards the head rail. In a central portion on the walls of recess 135 is detente or depression 137.

The lower portion 131 of valance bracket 113 has an arm 139 and hook portion 140 extending inwardly on the same side as hook portion 133. The combination of inwardly extending arms 139 and 133 permit the valance bracket to be secured to a previously mounted head rail by insertion of the top hook portion 133 and upper arm 129 up and over channel arm 141 of the head rail which, can then latch on to the channel arm 141 on the outer end of bracket 119. The valance bracket 113 is then brought down until contact of the outer catch portion 140 of lower arm 139 is made over the lower horizontal lip 112 of the head rail 111 to provide secure mounting of the valance bracket on head rail 111. As in the embodiment of FIG. 1, the bracket may also be slid on from an open edge.

Valances 114 and 115, shown in FIG. 4, each comprise an L-shaped structure having an upper horizontal portion or support flange 143 and a lower vertical portion or face 145 as in the embodiment of FIG. 1. Upper portion 143 has a projection 147 on its midsection, which is positioned on the upper arm 143 so that when the upper arm 143 of the valance 115 is inserted or slid sideways into the recess 135 of the valance bracket and pushed in substantially completely, projection 147 springs into depression 137 and holds the valance in place. When projection 147 and depression 137 are correctly positioned, the insertion of valance upper arm 143 into the valance bracket recess or channel 135 results in securing the valance to the valance bracket at the desired distance from the head rail.

The lower valance is secured to the lower valance bracket portion 159 in the same manner to result in parallel, spaced, and offset valances. Valance 114 is inserted or slid sideways into recess 155 and pushed substantially completely so that projection 153 springs into depression 157 and holds the valance in place. When both upper valance 115 and lower valance 114 are secured in this manner, parallel, spaced, and offsetting valance surfaces result in a pleasing double valance appearance. Different and contrasting color inserts may be placed into the valance as described above for a pleasant effect. A downwardly extending arm 134 may be placed on lower bracket portion 131 to provide a depending vertical support flange for the valance 114 in order to maintain the verticality of the valance. Vertical portion 127 of the upper bracket portion also may serve this purpose.

While the invention has been described with reference to a preferred embodiment, it will be understood by those skilled in the art that various changes may be made and equivalents may be substituted for elements thereof without departing from the scope of the invention In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments and equivalents falling within the scope of the appended claims.

Various features of the invention are set forth in the following claims.

What is claimed:

1. A valance assembly, including a head rail, a support means, a valance mounting means, and a valance;

said support means being mountable to a wall surface;

said head rail being secured to said support means for the support of a blind assembly;

said valance mounting means being mounted to said head rail and having a vertical central web between a lower horizontal arm and an upper horizontal arm, and said upper horizontal arm containing an outwardly opening and inwardly extended longitudinal horizontal recess;

said recess having a horizontal wall and a detent on said wall;

said valance comprising a display face and a support flange mounted thereon for achieving a substantially vertical position of said display face when said support flange is secured in said recess of said valance mounting means; and said support flange being mounted in said recess and having a detent element engaged with said recess detent, whereby said valance is supported by said valance mounting means on said support means.

2. The valance assembly of claim 1, wherein said support means comprises an arm secured to a wall surface, said arm having a support coupling means at an outer end.

3. The valance assembly of claim 1, wherein said valance mounting means is substantially in the shape of an I-beam for increased strength with a minimum of material.

4. The valance assembly of claim 1, wherein said valance mounting means is secured to said head rail by inwardly positioned upper and lower clip means on said respective upper and lower horizontal arms.

5. The valance assembly of claim 1, wherein said valance mounting means is formed of a plastic selected from the group consisting of polyoxymethylene, nylon, high density polyethylene, polypropylene, and polyvinyl chloride.

6. The valance assembly of claim 1, wherein said valance mounting means mounts two valances in a parallel, spaced, overlapping relationship.

7. The valance assembly of claim 1 wherein said recess detent comprises a depression on said horizontal wall, and said recess element on said valance support flange comprises a raised area for engagement with said depression.

8. A valance assembly, including a head rail, a blind assembly support means, a valance mounting means, and two valances;

said blind assembly support means having an inner end mountable to a wall surface and an outer end spaced therefrom;

said head rail being secured to said support means;

said valance mounting means being affixed on said outer end of said blind assembly support means and having upper and lower valance support means, each valance support means having a longitudinal horizontal recess;

each of said recesses having a horizontal side wall and a detent on said side wall;

said valances each having a support flange and a display face, said support flange mounted to said display face for achieving a substantially vertical position of said display face when secured in one of said recesses of said valance support means; and each of said upper and lower valance support means permitting insertion of one of said valance support flanges into one of said recesses, whereby said inserted valances are supported by said valance support means on said blind assembly support means in a parallel, spaced, and overlapping relationship.

9. The valance assembly of claim 8, wherein each of said support recesses includes a depression on an interior wall thereof for cooperation with a projection on each of said valance support flanges to retain said support flanges in said recesses.

10. The valance assembly of claim 8, wherein said lower valance support means has a depending vertical support flange for maintaining the verticality of the display face of a valance inserted in said lower valance support means.

11. The valance assembly of claim 7, wherein said valance mounting means is formed of a plastic selected from the group consisting of polyoxymethylene, nylon, high density polyethylene, polypropylene, and polyvinyl chloride.

12. The valance assembly of claim 7 wherein each valance support flange includes a detent element thereon for engaging said detents on said recess side walls.

13. The valance assembly of claim 12 wherein said recess detents comprise depressions on said recess side walls, and said detent elements on said valance support flanges comprise raised areas for engagement with said depressions.

14. The valance assembly of claim 8 wherein said valance mounting means is secured to said head rail on said outer end of said blind support means.

15. The valance assembly of claim 8 wherein said valance mounting means comprises a central web between an upper horizontal arm and a lower horizontal arm, and said upper horizontal arm includes said upper valance support means containing the upper longitudinal recess.

16. The valance assembly of claim 15 wherein said lower horizontal arm includes said lower valance support means containing the lower longitudinal recess.

17. The valance assembly of claim 14 wherein said valance mounting means is secured to said head rail by upper and lower clip means on respective upper and lower support arms.

18. A valance bracket, suitable for use in mounting a valance to the head rail of a vertical blind, which comprises:

a vertical central web between a lower horizontal arm and an upper horizontal arm, said upper horizontal arm containing an outwardly opening and inwardly extended longitudinal horizontal first recess, said first recess having a horizontal wall and a detent on said wall for receiving a first valance comprising a display face and a support flange perpendicularly mounted thereon, whereby said valance is secured to said valance bracket by insertion of said support flange into said first recess.

19. The valance bracket of claim 18 wherein said valance mounting means is substantially in the shape of an I-beam for increased strength with a minimum of material.

20. The valance bracket of claim 18 further including upper and lower clip means on an inside end of said respective upper and lower horizontal arms, whereby said valance bracket may be secured to a head rail.

21. The valance bracket of claim 18 wherein said valance bracket includes a second longitudinal horizontal recess for mounting a second valance in a parallel, spaced, overlapping relationship below said first valance.

22. A valance bracket, suitable for use in mounting at least one valance to the head rail of a vertical blind, which comprises:

upper and lower valance support means, each valance support means containing an outwardly opening and inwardly extended longitudinal horizontal recess, each of said recesses having a horizontal side wall including a detent on the side wall for receiving a valance comprising a display face and a support flange perpendicularly mounted thereon, whereby a pair of said valances are secured to said valance bracket by insertion of the support flanges of each of said pair of valances into a respective one of said recesses.

23. The valance bracket of claim 22 further including upper and lower clip means on an inside end of said respective upper and lower valance support means, whereby said valance bracket may be secured to a head rail.

* * * * *

UNITED STATES PATENT AND TRADEMARK OFFICE

CERTIFICATE OF CORRECTION

PATENT NO. : 4,840,216

DATED : June 20, 1989

INVENTOR(S) : Julius F. John

It is certified that error appears in the above-identified patent and that said Letters Patent is hereby corrected as shown below:

Col. 4, claim 7, line 68, "said recess element" should be --said detent element--.

Col. 5, claim 12, line 1, "7" should be --8--.

Col. 5, claim 12, line 3, "recess" should be --horizontal--.

Col. 5, claim 13, lines 1-2, "said recess detents" should be --detents on said horizontal side wall--.

Col. 6, claim 22, line 12, "are" should be --is--.

Signed and Sealed this

Twentieth Day of April, 1993

*Attest:*

*Attesting Officer*

MICHAEL K. KIRK

*Acting Commissioner of Patents and Trademarks*